US008567624B2

(12) United States Patent
Coley, Jr. et al.

(10) Patent No.: US 8,567,624 B2
(45) Date of Patent: Oct. 29, 2013

(54) LIGHTWEIGHT, HIGH STRENGTH BOTTLE

(75) Inventors: Ralph T. Coley, Jr., Cohasset, MA (US); Robert Kleinrath, Lakeville-Middleboro, MA (US); Daniel L. Witham, Holland, OH (US); Tracy Momany, Sylvania, OH (US); David Ryan, Toledo, OH (US); Masaaki Sasaki, Matsudo (JP); Takao Iizuka, Koto-ku (JP); Michael T. Lane, Brooklyn, MI (US)

(73) Assignee: Ocean Spray Cranberries, Inc., Lakeville-Middleboro, MA (US)

( * ) Notice: Subject to any disclaimer, the term of this patent is extended or adjusted under 35 U.S.C. 154(b) by 673 days.

(21) Appl. No.: 12/458,114

(22) Filed: Jun. 30, 2009

(65) Prior Publication Data

US 2010/0326951 A1 Dec. 30, 2010

(51) Int. Cl.
*B65D 90/02* (2006.01)

(52) U.S. Cl.
USPC ..... 215/384

(58) Field of Classification Search
USPC ..... 215/384, 383, 382, 381, 376, 379, 900; 220/675, 669, 624, 623, DIG. 14, 370, 220/666, 610, 600; D9/543, 542, 541, 569, D9/563, 530, 516
IPC ..... B65D 90/02,8/04
See application file for complete search history.

(56) References Cited

U.S. PATENT DOCUMENTS

D12,292 S * 6/1881 Babcock ..... D9/546
D22,058 S 12/1892 Rockwood
D58,077 S 6/1921 Eckl
D62,784 S 7/1923 Marble
D64,125 S 12/1923 Miller
D68,732 S 11/1925 Root
3,029,963 A * 4/1962 Evers ..... 215/373
3,426,939 A 2/1969 Young
3,434,626 A 3/1969 Kinslow, Jr.
3,784,040 A 1/1974 Douglas
4,046,275 A * 9/1977 Virog, Jr. et al. ..... 215/385
4,108,324 A 8/1978 Krishnakumar et al.
4,134,510 A 1/1979 Chang
4,197,954 A 4/1980 Oltman et al.
D294,120 S 2/1988 Griesing et al.
D294,679 S 3/1988 Griesing et al.

(Continued)

FOREIGN PATENT DOCUMENTS

EP 1354801 10/2003
JP 565158 3/1993

(Continued)

OTHER PUBLICATIONS

Iizuka et al., U.S. Appl. No. 60/144,243, filed Jul. 19, 1999.

(Continued)

*Primary Examiner* — Robert J Hicks
(74) *Attorney, Agent, or Firm* — Nixon & Vanderhye, PC

(57) ABSTRACT

A bottle includes a top portion and a bottom portion. The top portion includes a shoulder that extends away from a neck of the bottle, and a grip portion. The grip portion is recessed within the top portion of the bottle. The bottle may include a vacuum panel array and/or a rib array to help improve strength, reduce material and accommodate deformation forces tending to collapse the bottle upon filling with pasteurized contents.

26 Claims, 13 Drawing Sheets

(56) References Cited

U.S. PATENT DOCUMENTS

| | | | | |
|---|---|---|---|---|
| D300,005 | S | 2/1989 | Jacobs et al. | |
| 4,805,788 | A | 2/1989 | Akiho | |
| 4,850,493 | A | 7/1989 | Howard, Jr. | |
| D308,482 | S | 6/1990 | Wild | |
| 4,949,861 | A | 8/1990 | Cochran | |
| D315,678 | S | 3/1991 | Darr | |
| 5,005,716 | A | 4/1991 | Eberle | |
| 5,067,622 | A | 11/1991 | Garver et al. | |
| 5,158,817 | A | 10/1992 | Krishnakumar | |
| 5,217,128 | A | 6/1993 | Stenger et al. | |
| 5,222,615 | A | 6/1993 | Ota et al. | |
| 5,224,614 | A * | 7/1993 | Bono et al. | 215/384 |
| 5,238,129 | A | 8/1993 | Ota | |
| 5,246,122 | A | 9/1993 | Schick et al. | |
| 5,269,437 | A | 12/1993 | Gygax | |
| D346,556 | S | 5/1994 | Sirico et al. | |
| D347,391 | S | 5/1994 | Guertin | |
| 5,337,909 | A | 8/1994 | Vailliencourt | |
| D354,000 | S | 1/1995 | Hoyt | |
| 5,381,910 | A * | 1/1995 | Sugiura et al. | 215/398 |
| 5,593,056 | A | 1/1997 | Mero et al. | |
| D388,330 | S | 12/1997 | Zimmer | |
| 5,713,480 | A | 2/1998 | Petre et al. | |
| D392,188 | S | 3/1998 | Darr et al. | |
| 5,732,838 | A | 3/1998 | Young | |
| 5,735,421 | A | 4/1998 | Deemer et al. | |
| 5,758,790 | A | 6/1998 | Ewing, Jr. | |
| 5,762,221 | A | 6/1998 | Tobias et al. | |
| 5,833,115 | A | 11/1998 | Eiten | |
| 5,848,516 | A | 12/1998 | Ban | |
| D408,739 | S | 4/1999 | Satterfield et al. | |
| 5,908,127 | A | 6/1999 | Weick et al. | |
| D411,803 | S | 7/1999 | Guertin | |
| D412,119 | S | 7/1999 | Guertin | |
| 5,971,184 | A | 10/1999 | Krishnakumar et al. | |
| 5,988,417 | A | 11/1999 | Chen et al. | |
| 6,016,932 | A | 1/2000 | Gaydosh et al. | |
| 6,029,837 | A | 2/2000 | Slat et al. | |
| D421,721 | S | 3/2000 | Guertin | |
| D428,338 | S | 7/2000 | Iizuka et al. | |
| 6,095,360 | A | 8/2000 | Shmagin et al. | |
| 6,112,925 | A | 9/2000 | Nahill et al. | |
| 6,149,024 | A | 11/2000 | Deemer et al. | |
| 6,161,713 | A | 12/2000 | Krich | |
| 6,213,326 | B1 | 4/2001 | Denner et al. | |
| 6,264,053 | B1 | 7/2001 | Slat | |
| 6,277,321 | B1 | 8/2001 | Valliencourt et al. | |
| D451,032 | S | 11/2001 | Iizuka et al. | |
| D452,444 | S | 12/2001 | Iizuka et al. | |
| D454,069 | S | 3/2002 | Guislain | |
| D454,072 | S | 3/2002 | Harrity et al. | |
| D459,234 | S | 6/2002 | Bourque et al. | |
| 6,467,639 | B2 | 10/2002 | Mooney | |
| 6,569,376 | B2 | 5/2003 | Wurster et al. | |
| 6,575,321 | B2 | 6/2003 | Bourque et al. | |
| D481,318 | S | 10/2003 | Iizuka et al. | |
| 6,637,612 | B2 | 10/2003 | Maczek | |
| 6,662,961 | B2 | 12/2003 | Yourist | |
| 6,666,001 | B2 | 12/2003 | Mero | |
| 6,672,468 | B1 | 1/2004 | Mount et al. | |
| 6,672,470 | B2 | 1/2004 | Wurster et al. | |
| 6,749,075 | B2 | 6/2004 | Bourque et al. | |
| 6,752,284 | B1 | 6/2004 | Akiyama et al. | |
| D503,627 | S | 4/2005 | Johnston et al. | |
| D507,746 | S | 7/2005 | Sasaki et al. | |
| 6,913,405 | B2 | 7/2005 | Fischer et al. | |
| 6,926,163 | B2 | 8/2005 | Darr et al. | |
| D509,741 | S * | 9/2005 | Collins et al. | D9/516 |
| 6,974,047 | B2 | 12/2005 | Kelley et al. | |
| 6,981,604 | B2 | 1/2006 | Iizuka et al. | |
| 6,997,336 | B2 | 2/2006 | Yourist et al. | |
| 6,998,091 | B2 | 2/2006 | Iizuka et al. | |
| 7,004,342 | B2 | 2/2006 | Bourque et al. | |
| 7,017,763 | B2 | 3/2006 | Kelley | |
| 7,055,711 | B2 | 6/2006 | Sasaki et al. | |
| 7,059,486 | B2 | 6/2006 | Van Der Heijden et al. | |
| 7,066,345 | B2 | 6/2006 | Itokawa et al. | |
| D525,527 | S | 7/2006 | Ogg | |
| D525,528 | S | 7/2006 | Lane et al. | |
| D526,198 | S | 8/2006 | Sasaki et al. | |
| D527,266 | S | 8/2006 | Yourist et al. | |
| 7,097,061 | B2 | 8/2006 | Simpson, Jr. et al. | |
| D528,421 | S | 9/2006 | Sasaki et al. | |
| D528,427 | S | 9/2006 | Sasaki et al. | |
| D533,782 | S | 12/2006 | Ogg et al. | |
| D547,670 | S | 7/2007 | Heisner | |
| D560,496 | S | 1/2008 | Heisner | |
| D561,038 | S | 2/2008 | Yourist et al. | |
| D564,890 | S | 3/2008 | Coley et al. | |
| 7,350,658 | B2 * | 4/2008 | Bourque et al. | 215/384 |
| D568,167 | S | 5/2008 | Sasaki et al. | |
| D568,169 | S | 5/2008 | Sasaki et al. | |
| D569,257 | S | 5/2008 | Yourist et al. | |
| D574,715 | S | 8/2008 | Sasaki et al. | |
| D577,594 | S | 9/2008 | Sasaki et al. | |
| D578,400 | S | 10/2008 | Sasaki et al. | |
| D598,774 | S | 8/2009 | Schlies et al. | |
| D598,782 | S | 8/2009 | Sasaki et al. | |
| 2001/0035392 | A1 | 11/2001 | Ota et al. | |
| 2001/0037992 | A1 | 11/2001 | Tanabe et al. | |
| 2001/0054597 | A1 * | 12/2001 | Ozawa et al. | 215/381 |
| 2002/0074336 | A1 | 6/2002 | Silvers | |
| 2002/0104820 | A1 * | 8/2002 | Hong et al. | 215/381 |
| 2003/0116526 | A1 | 6/2003 | Mehanna | |
| 2003/0161980 | A1 | 8/2003 | Nelson | |
| 2003/0205550 | A1 | 11/2003 | Prevot et al. | |
| 2004/0050851 | A1 * | 3/2004 | Ilzuka et al. | 220/669 |
| 2004/0074864 | A1 * | 4/2004 | Melrose et al. | 215/381 |
| 2004/0129669 | A1 | 7/2004 | Kelley et al. | |
| 2004/0144747 | A1 * | 7/2004 | Saito et al. | 215/379 |
| 2004/0144748 | A1 * | 7/2004 | Slat et al. | 215/382 |
| 2004/0164046 | A1 | 8/2004 | Kelley | |
| 2004/0164047 | A1 | 8/2004 | White | |
| 2004/0195200 | A1 * | 10/2004 | Bourque et al. | 215/384 |
| 2005/0092708 | A1 * | 5/2005 | Heisner et al. | 215/384 |
| 2005/0211660 | A1 | 9/2005 | Galownia et al. | |
| 2005/0211661 | A1 | 9/2005 | Galownia et al. | |
| 2005/0218107 | A1 | 10/2005 | Sabold et al. | |
| 2006/0151425 | A1 | 7/2006 | Kelley et al. | |
| 2006/0175283 | A1 | 8/2006 | Piccioli et al. | |
| 2006/0207962 | A1 | 9/2006 | Coley, Jr. et al. | |
| 2007/0039918 | A1 * | 2/2007 | Lane et al. | 215/381 |
| 2007/0045222 | A1 | 3/2007 | Denner et al. | |
| 2007/0170143 | A1 * | 7/2007 | Shmagin | 215/381 |
| 2007/0187354 | A1 * | 8/2007 | Sasaki | 215/384 |
| 2007/0257003 | A1 * | 11/2007 | Colloud | 215/382 |
| 2008/0190884 | A1 * | 8/2008 | Maczek et al. | 215/381 |
| 2010/0326950 | A1 * | 12/2010 | Lane | 215/381 |

FOREIGN PATENT DOCUMENTS

| | | |
|---|---|---|
| JP | 408301253 | 11/1996 |
| JP | 2001315741 | 11/2001 |
| WO | WO 97/34808 | 9/1997 |
| WO | WO 2004/094261 | 11/2004 |

OTHER PUBLICATIONS

Screen Shot A from advertisement airing Mar. 3, 2008.
Screen Shot B from advertisement airing Mar. 3, 2008.
Screen Shot C from advertisement airing Mar. 23, 2009.
Screen Shot D from advertisement airing Jan. 12, 2009.

* cited by examiner

LIGHTWEIGHT, HIGH STRENGTH BOTTLE

BACKGROUND OF THE INVENTION

FIG. 1 shows a prior art bottle having a generally rectangular configuration. This bottle is the subject of U.S. Pat. Nos. 6,575,321, 6,749,075, 7,004,342 and 7,350,658 each incorporated herein by reference in its entirety. While that bottle has enjoyed commercial success and very satisfactorily performs its intended functions, there is an ever growing need to improve such bottles, e.g., to reduce weight (and material) and to increase strength, and to reduce the cost for shipping such bottles.

For example, the bottle shown in FIG. 1 is typically shipped from a beverage packer, e.g., cranberry juice, to the distribution outlets (e.g., grocery store) using conventional cardboard cases each holding eight bottles, and it is not unusual that five cases are stacked one on top of the other for a total of 40 bottles. In this case, the lowermost layer of eight bottles supports the weight of the remaining 32 bottles, each 64 oz. bottle weighing about four lbs, or 32 bottles×4 lbs each=128 lbs. When the cases are stacked as such, a corrugate (formed from the top of a lower case and the adjacent bottom of an upper case) is provided between each layer, for added load bearing, as each bottle has a top loading capacity of about 45 lbs.

In addition, the top portion of the bottle shown in FIG. 1 may receive an auxiliary (adhesive) label in the grip area and/or a label (e.g., a wrap around label) positioned between upper and lower label bumpers of the bottle, as described in U.S. Pat. Nos. 6,575,321, 6,749,075, 7,004,342 and 7,350,658. Labeling is applied during or after the bottling process in which the bottle is held firmly by the top and bottom ends. Because the contained beverage may be pasteurized, the side walls of the container are subject to vacuum deformation which in part is dealt with by providing the bottle with vacuum accommodating sections such as vacuum panels on the bottom portion of the container, or auxiliary vacuum deformation portions that may be located in the grip portion, the base portion and/or other portions of the bottle. Vacuum deformation in the top part of the bottle where the label is to be applied can compromise the positioning and/or registration of the auxiliary label.

Thus, a need has developed in the bottling art to provide address one or more of these challenges.

BRIEF SUMMARY OF THE INVENTION

One aspect of the present invention relates to an improved rectangular bottle design to better distribute load, e.g., by transferring load to corners and heel or base.

Another aspect is to allow for material reduction, while maintaining the bottle's strength and load capacity, as well as the bottle's ability to accommodate for or otherwise resist vacuum deformation.

Another aspect is to provide a tapered material between heel corners to provide stability while conveying during manufacturing or filling.

Another aspect is to provide an improved logo/grip portion, by providing a relatively deeper cut on the brow or perimeter to strengthen logo area to allow for filler pressure and material reduction.

Another aspect is to provide a vacuum panel array in the top and/or bottom portions of the bottle to accommodate for any forces introduced during the pasteurization process during a filling operation.

Another aspect is directed to a bottle having a reinforced top portion, e.g., on a rectangular bottle.

Another aspect relates to reducing the amount of corrugate cardboard casing used to ship containers, e.g., by eliminating the top cover of the case.

Another aspect of the present invention relates to a hot-fillable or cold-fillable plastic bottle, comprising a body portion having a top portion and a bottom portion, the top portion including a shoulder positioned below a finish or neck, and a grip portion below the shoulder. The body portion where the shoulder is located may have a polygonal shape, e.g., rectangular, with side walls joined by curved corner or transition portions. Each, or one or more, of said portions may include a corner rib array that extends along the top portion. The rib array may include two or more ribs that are least partly but not completely coextensive or overlapping, e.g., the ribs may be of different lengths, or the ribs may have similar heights but be offset from one another along the longitudinal axis of the bottle. In one example, the corner array may include three or more such ribs, all being offset from and/or of different dimensions from one another. In another alternative, two of the ribs may be coextensive, while a third rib may be offset and/or of a different length.

In one form, the bottle is made from blow-molded plastic (e.g., PET or another suitable plastic). The bottle has a substantially rectangular shape and includes an upper portion and a lower portion. The upper portion includes a finish or neck (with at least one thread) that defines an opening for filling and dispensing of fluid contents. The upper portion includes a shoulder portion, e.g., bell-shaped, below the finish/neck, and a pair of opposed recessed grip portions below the shoulder where the bottle takes on a generally rectangular cross-sectional/shape. Each corner of the shoulder may include a rib array, which is positioned along the corner, but can also be positioned elsewhere. The rib array may include a set of two or more, e.g., three, reinforcing ribs. At least two of the ribs may extend vertically from essentially the middle of the bottle (at or just above the transition between the top and bottom portions) to at least above or adjacent the grip portions, and at least one of the two ribs may extend even higher, just below the neck. A third rib may be oriented towards the broader side of the bottle, and extends from the neck down to the upper boundary of the grip portion.

One or more additional relatively smaller ribs may be provided on each side of the grip portions. Further, one or more laterally extending ribs (e.g., three lateral ribs having the same or different lengths) may be provided on each of the shorter walls of the bottle. The shorter walls may also include one or more relatively smaller ribs provided on each lateral side of the horizontal rib(s). The terms "vertical" and "lateral" or horizontal are taken when the bottle is resting upright on its base.

The lower portion of the bottle may include one or more vacuum panels, e.g., on each of the four sides of the bottle. Each vacuum panel is reinforced with a plurality of recessed grooves or ribs, e.g., 2-6 ribs. The vacuum panels help to accommodate for shrinkage that occurs during filling or when the hot-filled contents begin to cool after the bottle is capped.

The bottle may include a base portion having a push-up portion with a two stage, elliptical shape.

The bottle may also include a vacuum panel array, including one or more vacuum deformation portions positioned on the top portion of the main body. For example, one side of the bottle may include a recessed vacuum deformation portion (e.g., having a tapered or trapezoidal shape) on the wider or larger side walls of the top portion, e.g., between rib arrays on adjacent corners. Another vacuum deformation portion, e.g., having an hour glass shape, may be provided on the shorter side walls of the bottle, e.g., between rib arrays on adjacent corners. The grip portion may also form a vacuum deformation portion.

According to one aspect of the invention, there is provided a plastic bottle, comprising a generally rectangular body portion having a top portion and a bottom portion, the top portion including a shoulder, a grip portion below the shoulder and at least one corner rib array including at least two ribs having different lengths and/or axially offset from one another.

According to another aspect of the invention, there is provided a plastic bottle, comprising a generally rectangular body portion having a top portion and a bottom portion, the rectangular body portion including relatively longer and shorter side walls, the top portion including a shoulder and a grip portion below the shoulder, said top portion including a vacuum panel array including a first vacuum deformation portion provided as part of the grip portion, a second vacuum deformation portion provided above the grip portion, and a third vacuum deformation portion provided on the shorter side walls of the bottle.

According to another aspect of the invention, there is provided a plastic bottle, comprising a generally rectangular body portion having a top portion and a bottom portion, the top portion including a shoulder, a grip portion below the shoulder and at least one corner rib array including at least two ribs each having a length greater than a height of the grip portion.

According to another aspect of the invention, there is provided a plastic bottle, comprising a generally rectangular body portion having a top portion and a bottom portion, the top portion including a shoulder and a grip portion below the shoulder, the grip portion being recessed into the top portion, the grip portion defining a main surface recessed to a first depth and surrounded by a perimeter, at least a portion of the perimeter being recessed to a second depth that is deeper than the first depth.

According to another aspect of the invention, there is provided a plastic bottle, comprising a generally rectangular body portion having a top portion and a bottom portion, the top portion including a shoulder, a grip portion below the shoulder and a heel corner portions below the bottom portion; and a tapered material between adjacent heel corners to provide stability while conveying.

According to another aspect of the invention, there is provided a plastic bottle comprising a generally rectangular body portion identical a top portion, a bottom portion and a base or heel portion below the bottom portion, the heel or base portion having a tapered portion angled relative to the adjacent side walls of the bottle.

These and other aspects will be described in or apparent from the following description of preferred embodiments.

DETAILED DESCRIPTION OF EXAMPLES

Figure 1:
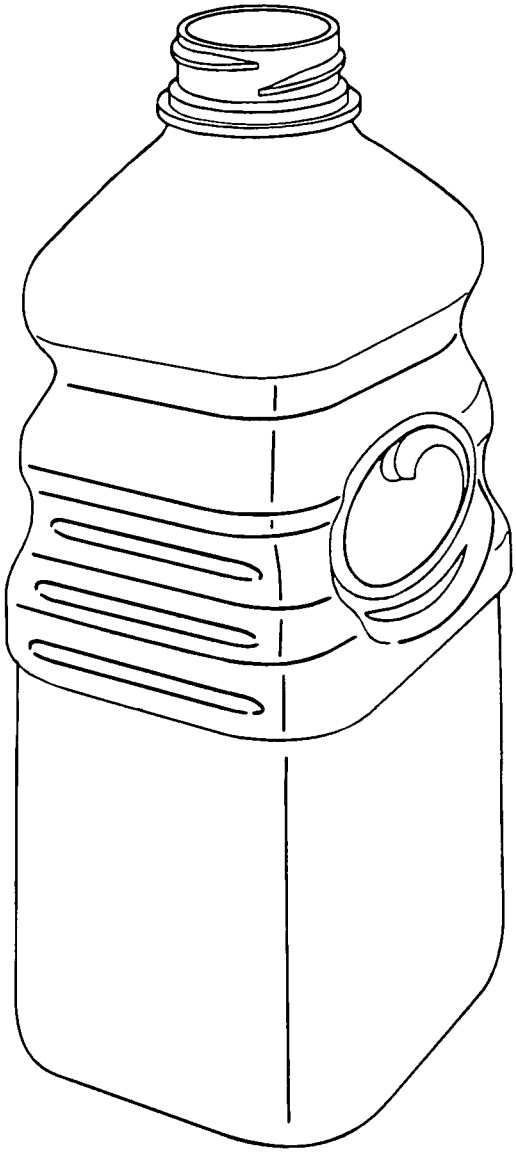
FIG. 1 (Prior Art)
FIG. 1 is a perspective view from the top, front side of a prior art bottle.

The following description is provided in relation to several examples that may share common characteristics and/or features. It is to be understood that one or more features of any one example may be combinable with one or more features of the other examples. In addition, any single feature or combination of features in any of the examples may constitute additional aspects of the invention.

FIGS. 2-9, 10-16 and 17-21 show examples of bottles made according to the present invention. In the figures, reference number 10 designates a plastic bottle or container, e.g. a polyethylene terephthalate (PET), hot-fillable or cold-fillable beverage container. Typically, a hot fillable bottle will include one or more vacuum panels, while it is not necessary for cold fill bottles to include such vacuum panels. However, a hot fillable bottle can be used for cold fill applications. The bottle may have a filling capacity of 64 oz., 60 oz., 96 oz., or smaller than 60 oz. or larger than 96 oz., etc. Also, while described in conjunction with rectangular bottles, such features may also have application to other types of bottles, e.g., round bottles, etc.

The bottle 10 includes a neck 30 and a body portion 40 that extends away from the neck 30. The neck 30 may be crystallized to have a substantially opaque appearance, as is well known in the art. However, it is not necessary to provide a crystallized neck. The body portion 40 includes a top portion 45 and a bottom portion 50, which in the exemplary embodiment has a vacuum deformation portion 55 that is shorter than the top portion 45. A base or heel portion 25 is provided below the vacuum deformation portion 55.

The bottle 10 is manufactured, for example, using a blow-molding process which is well known. During blow-molding, a preform (not shown) is expanded and assumes the shape of an interior molding surface, i.e., a mold (not shown), to form a substantially transparent, biaxially-oriented bottle. The neck 30 of the preform is not expanded and remains as the neck 30 of the bottle 10. The neck 30 includes threads and an open mouth 35 for receiving a screw-on cap (not shown). The lower portion of the preform is expanded to form the body portion 40 of the bottle 10, including the top portion 45 and the bottom portion 50.

Figure 2:
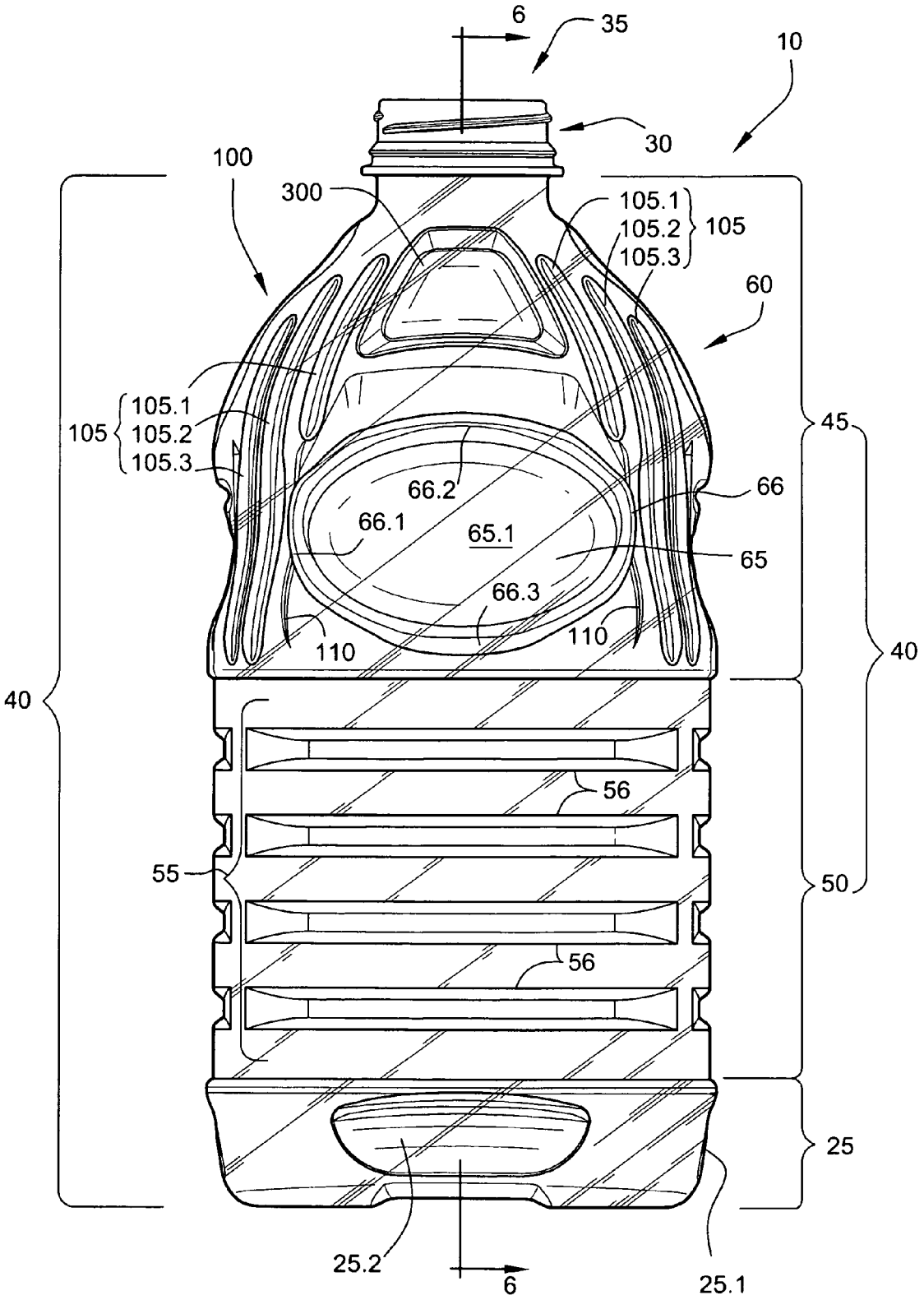
FIG. 2 is a front elevation view of a bottle according to one example of the present invention, the rear view thereof being identical thereto.
Figure 3:
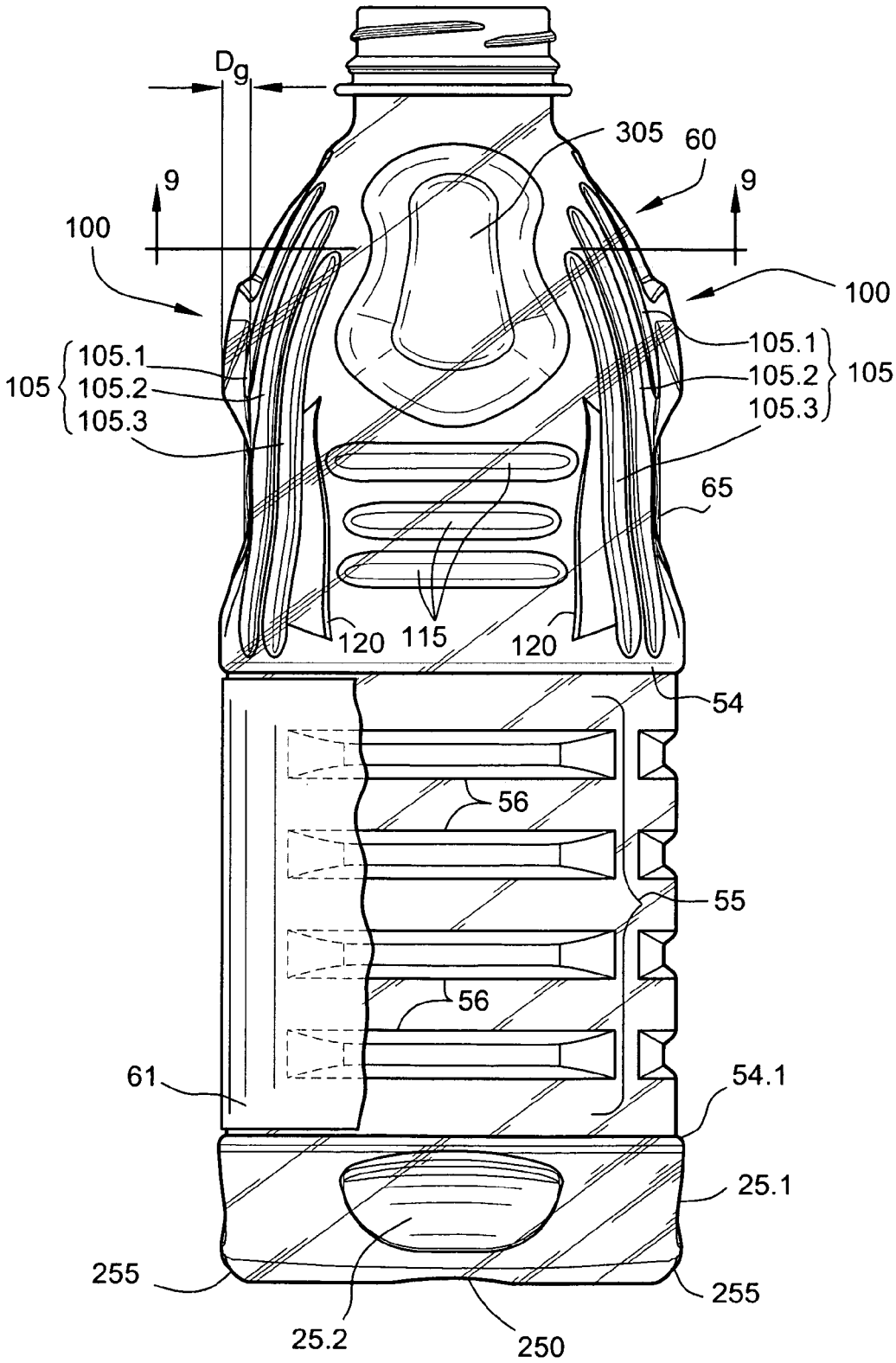
FIG. 3 is a left side view of the bottle shown in FIG. 2, with the opposite view thereof being identical thereto.

The bottom portion 50 of the bottle 10, as shown in FIGS. 2 and 3, includes a plurality of vacuum deformation portions 55, e.g., in the form of panels. Vacuum deformation portions 55 may be in the form of a panel section recessed into the bottom portion 1-5 mm or more.

The base 25 is provided below the vacuum deformation portions 55. For example, each of the longer sides 15 and shorter sides 20 of the container 10 includes a vacuum deformation portion 55. The vacuum deformation portions 55 accommodate internal forces tending to collapse the both inwardly due to filling the container 10 with a liquid at an elevated temperature, e.g., a pasteurization temperature. After the container 10 is hot-filled and capped, cooling of the liquid tends to collapse the vacuum deformation portions 55.

While this example relates to hot-fill applications, it is also contemplated that the bottle 10 can be used in cold-fill applications. For example, the bottle can be made using an aseptic cold-fill line.

Each vacuum deformation portion 55 may include at least one, e.g., 4-6, lateral stiffening ribs 56 to add rigidity, e.g., to prevent more than a certain amount of deformation of the vacuum deformation portions 55. The vacuum deformation portions 55 on the shorter sides 15 generally accommodate a lesser amount of the internal forces as compared to the vacuum panels on the longer sides 20.

Further, the bottom portion 50 of the bottle 10 is adapted to receive a label 61 (FIG. 3) which is wrapped, e.g., shrink-wrapped, around the vacuum deformation portions 55. For example, the label 61 (only a portion is shown) wraps about the entire perimeter of the container 10. The label 61 is positioned below a transition shoulder 54 between the top and bottom portions 45, 50 of the body portion 40. A lower transition shoulder 54.1 defines a lowermost boundary of the label 61. The label 61 could include one or more separate parts to be individually applied to only one or more of the longer and/or shorter sides.

Bottle 10 includes a shoulder or dome portion 60 and a grip portion 65 provided below shoulder 60. The grip portion 65 is inwardly recessed into the body portion 40. For example, the grip portions 65 on opposite sides of the bottle 10 are spaced a distance that is less than the width of the top portion of the bottle. Preferably, each grip portion 65 is recessed a depth $D_g$ which is about 1-20 mm or more, and preferably, about 5-15 mm into the body portion 40, as shown in FIG. 3. In embodiments, the depth $D_g$ may be only a few millimeters, e.g., 1-5 mm. As a result, the border of each grip portion 65 includes a ledge 66 (FIG. 2) that improves gripability. Preferably, the ledge 66 substantially surrounds the entire grip portion 65, although it is possible that less than the entire perimeter of the grip portion 65 includes the ledge. For example, the ledge may be limited to just the lateral (left and right) sides or one lateral or upper side of the grip portion 65, e.g., near the upper brow where the user grips the container 10. The grip portion 65 may have a very shallow depth (e.g. 1-5 mm) on the lateral sides 66.1 and the upper side 66.2, and increased depth (2-7 mm) on the lower side 66.3. Alternatively, the lateral and upper sides may have a depth that is greater than the depth on the lower side. Further, although the grip portion 65 is shown as generally oval shaped, it can take the form of other shapes such as circles, diamonds, rectangles or other geometric shapes.

Figure 6:
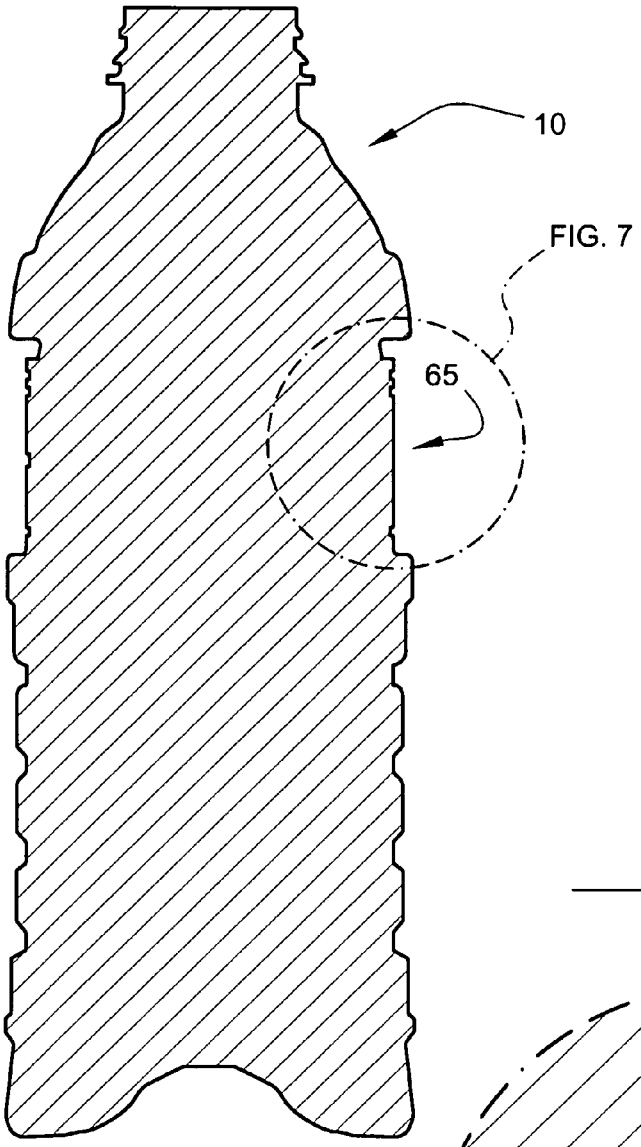
FIG. 6 is a cross-sectional view taken along line 6-6 of FIG. 2.
Figure 7:
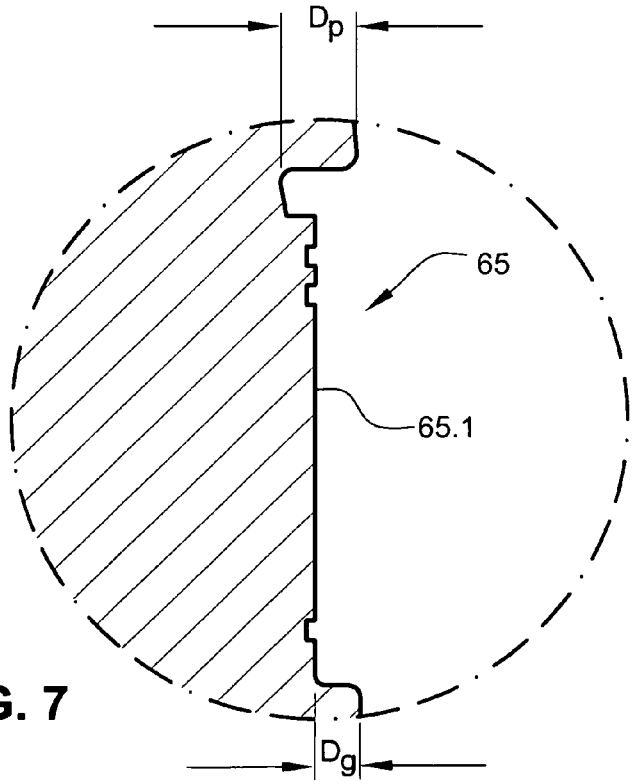
FIG. 7 is a detail view of FIG. 6.
Figure 8:
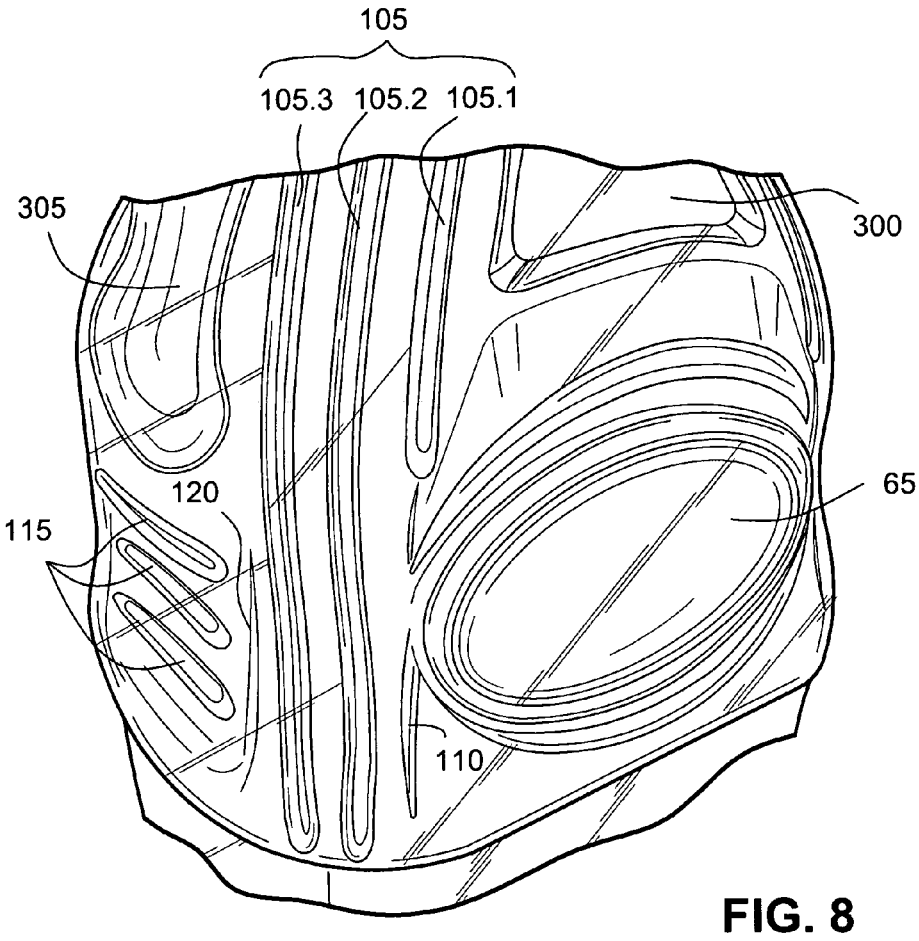
FIG. 8 is an enlarged perspective view of a portion of the bottle of FIG. 2.
Figure 9:
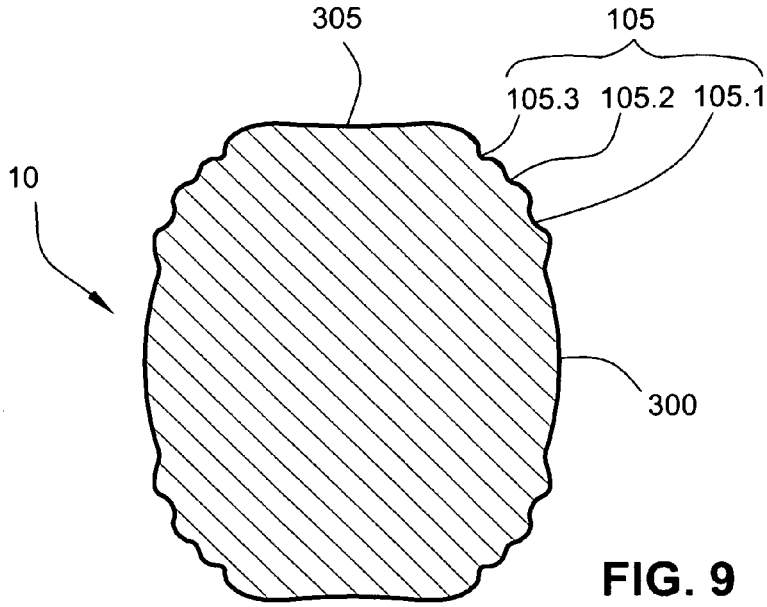
FIG. 9 is a cross-sectional view taken along line 9-9 of FIG. 3.

As shown in FIGS. 6 and 7, the grip portion 65 defines a main surface 65.1 (with the logo or label) recessed to a first depth $D_g$ (in the ranges defined above) and surrounded by a perimeter. At least a portion of the perimeter is recessed to a second depth $D_p$ that is deeper than the first depth $D_g$, e.g., by 2-7 mm, to strengthen the logo area and allow for filler pressure and material reduction. In one example, the deeper cut $D_p$ is about 6-8 mm, while the surface depth $D_g$ is about 4-6 mm. The portion of the perimeter of increased depth includes an upper portion or "brow" of the perimeter. The lower portion of the perimeter may have a depth that is equal to the depth of surface 65.1, as shown in FIG. 7, or the lower perimeter portion may have a depth that is equal to the depth $D_v$ of the brow portion.

As shown in FIGS. 2-5 and 10 and 11, bottle 10 includes corner or transition portions 100 joining adjacent walls 15, 20 of the rectangular main body. Each, or one or more, of the corner or transition portions 100 may include a corner rib array 105 that extends along the top portion 45. The rib array may include two or more ribs 105.1, 105.2, 105.3 (FIGS. 2-9 and 17-18) or 105.4 or 105.5 (FIGS. 10-16) that are least partly but not completely coextensive or overlapping, e.g., the ribs may be of different lengths (e.g., ribs 105.2 can be larger than rib 105.1 and shorter than rib 105.3), or the ribs may have similar and/or different heights but be offset from one another along the longitudinal axis of the bottle (e.g., rib 105.1 has an upper extent that is higher than rib 105.2, and rib 105.2 has an upper extent that is higher than rib 105.3). The upper extent of the ribs may be said to be cascading along the dome portion, e.g., from the center towards the edges as viewed in FIGS. 2 and 17 or from the center towards the edge as viewed in FIG. 11.

In one example (FIGS. 2-9 and 17-18), the corner array may include three or more such ribs, all being offset from and/or of different dimensions from one another. In another alternative, two of the ribs may be coextensive or generally the same length, while a third rib may be offset and/or of a different length. The ribs may be in the form of a groove recessed within, or a bead protruding out, the top portion, or a combination thereof. The width of the grooves can be generally equal, e.g., about 2-10 mm or 3-5 mm, or the width of each of the grooves may be different from one another. Also, the ribs can have a generally uniform cross-section along their lengths, or the cross-section can vary, e.g., the ribs can taper in terms of width and/or depth. Also, the spacing between ribs can be constant or variable.

Figure 10:
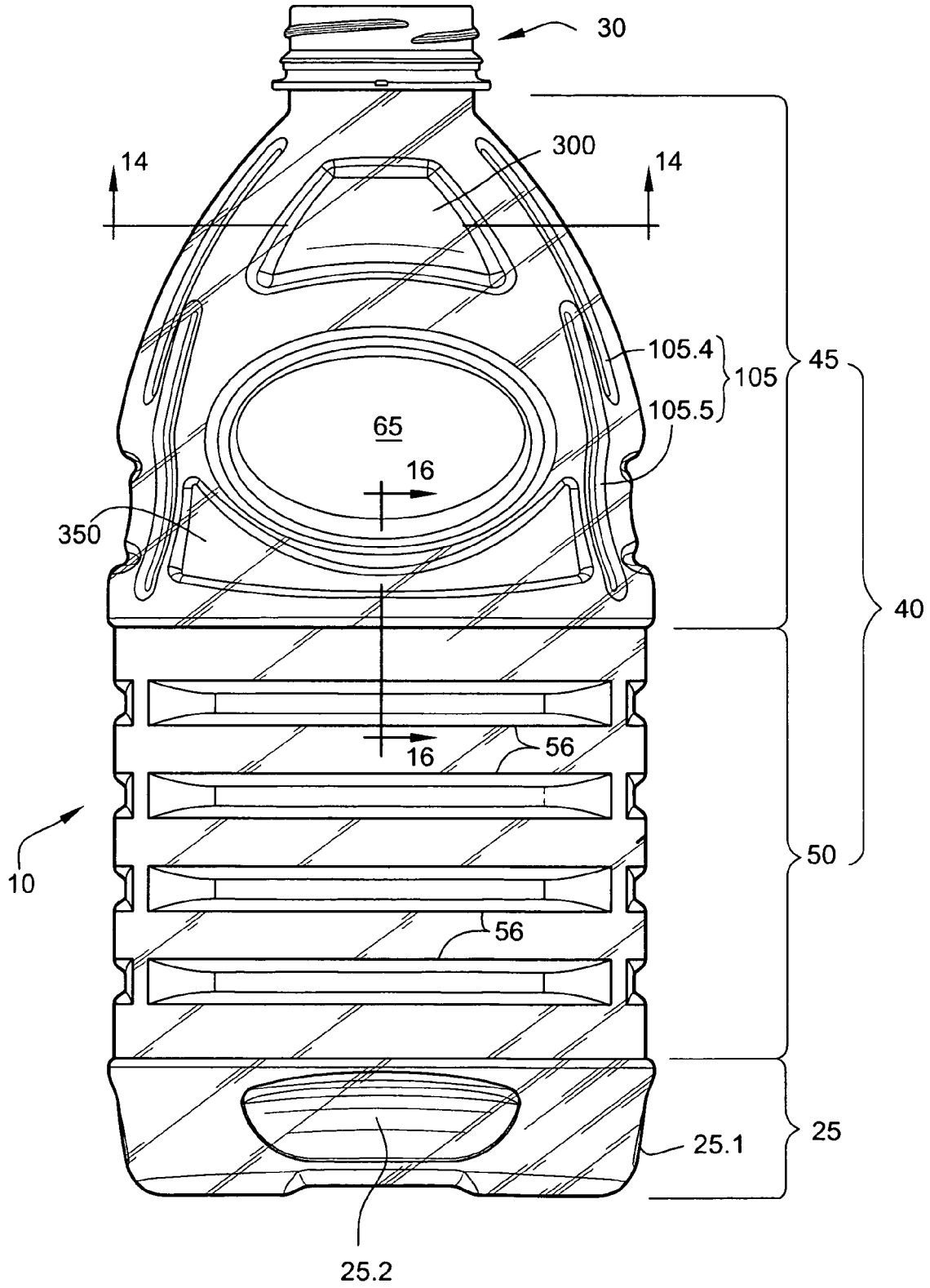
FIG. 10 is a front elevation view of a bottle according to another example of the present invention, the rear view thereof being identical thereto.
Figure 11:
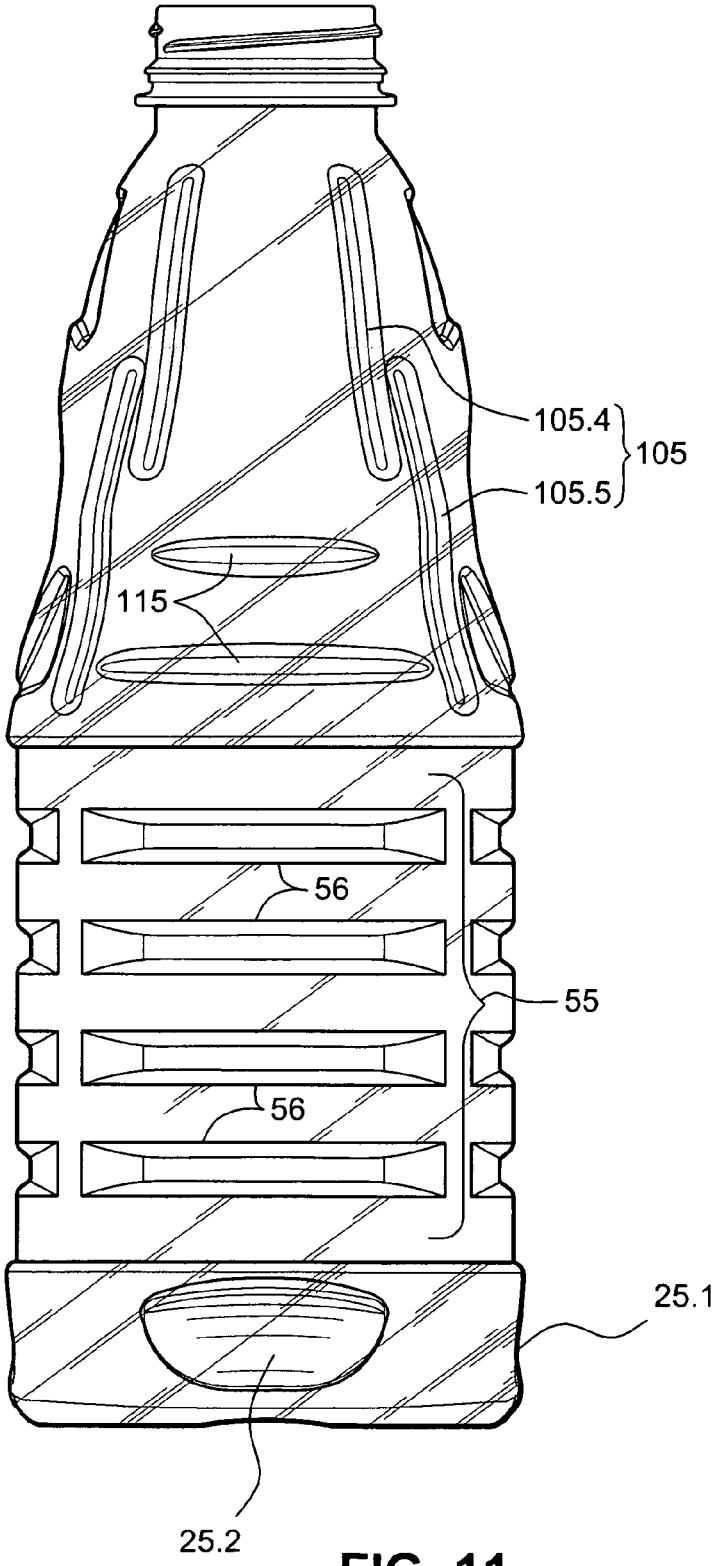
FIG. 11 is a left side view of the bottle shown in FIG. 10, with the opposite view thereof being identical thereto.
Figure 12:
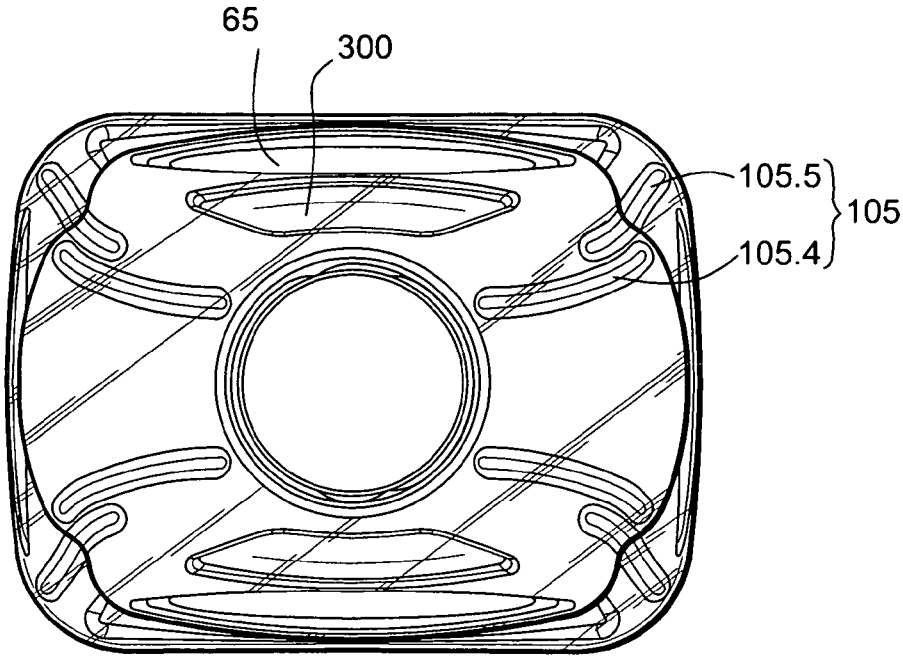
FIG. 12 is a top view of the bottle shown in FIG. 10.
Figure 13:
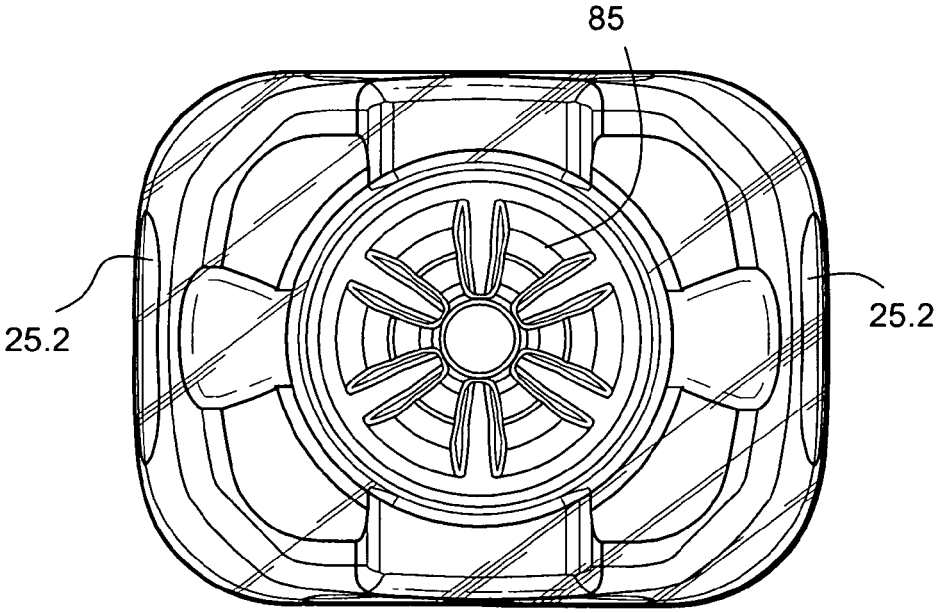
FIG. 13 is the bottom view of the bottle shown in FIG. 10.
Figure 14:
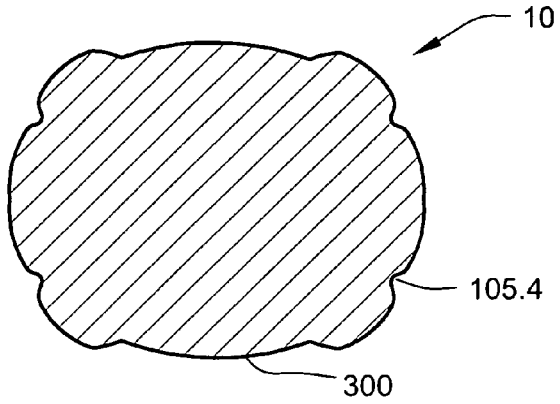
FIG. 14 is a cross-sectional view taken along lines 14-14 of FIG. 10.
Figure 15:
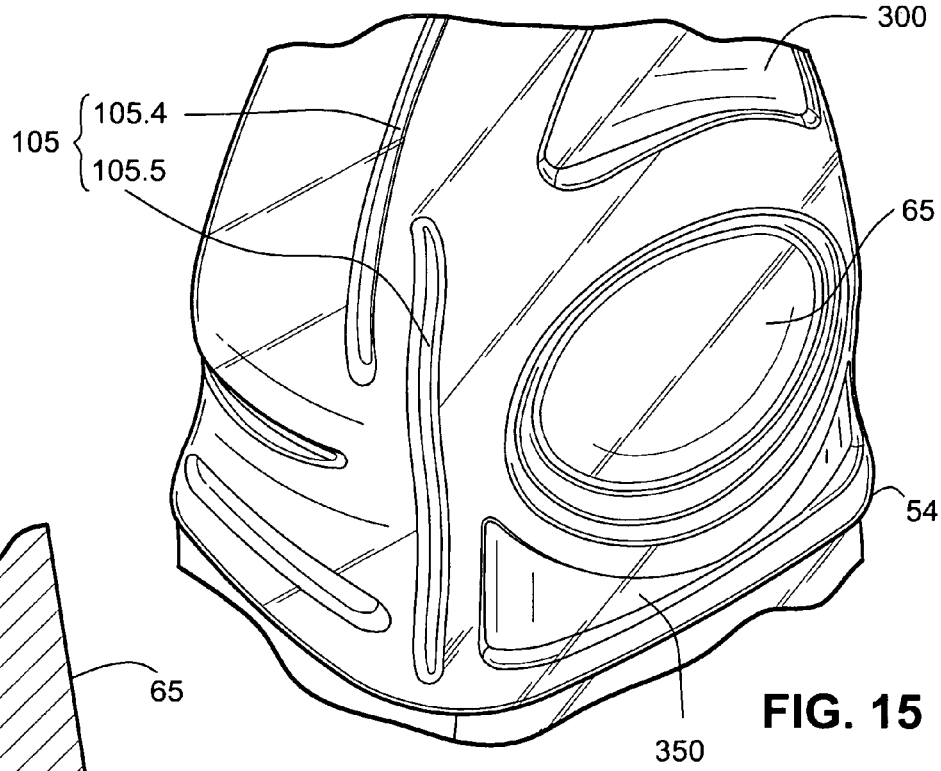
FIG. 15 is an enlarged, perspective view of a portion of the bottle shown in FIG. 10.
Figure 16:
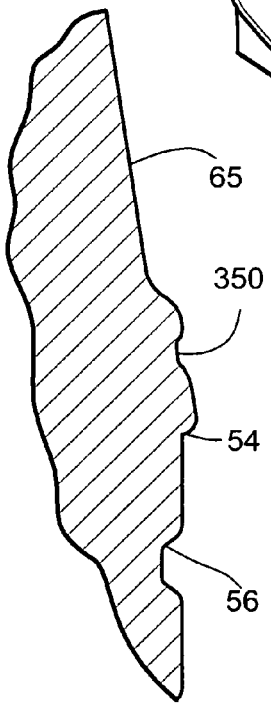
FIG. 16 is a cross-sectional view taken along lines 16-16 of FIG. 10.
Figure 17:
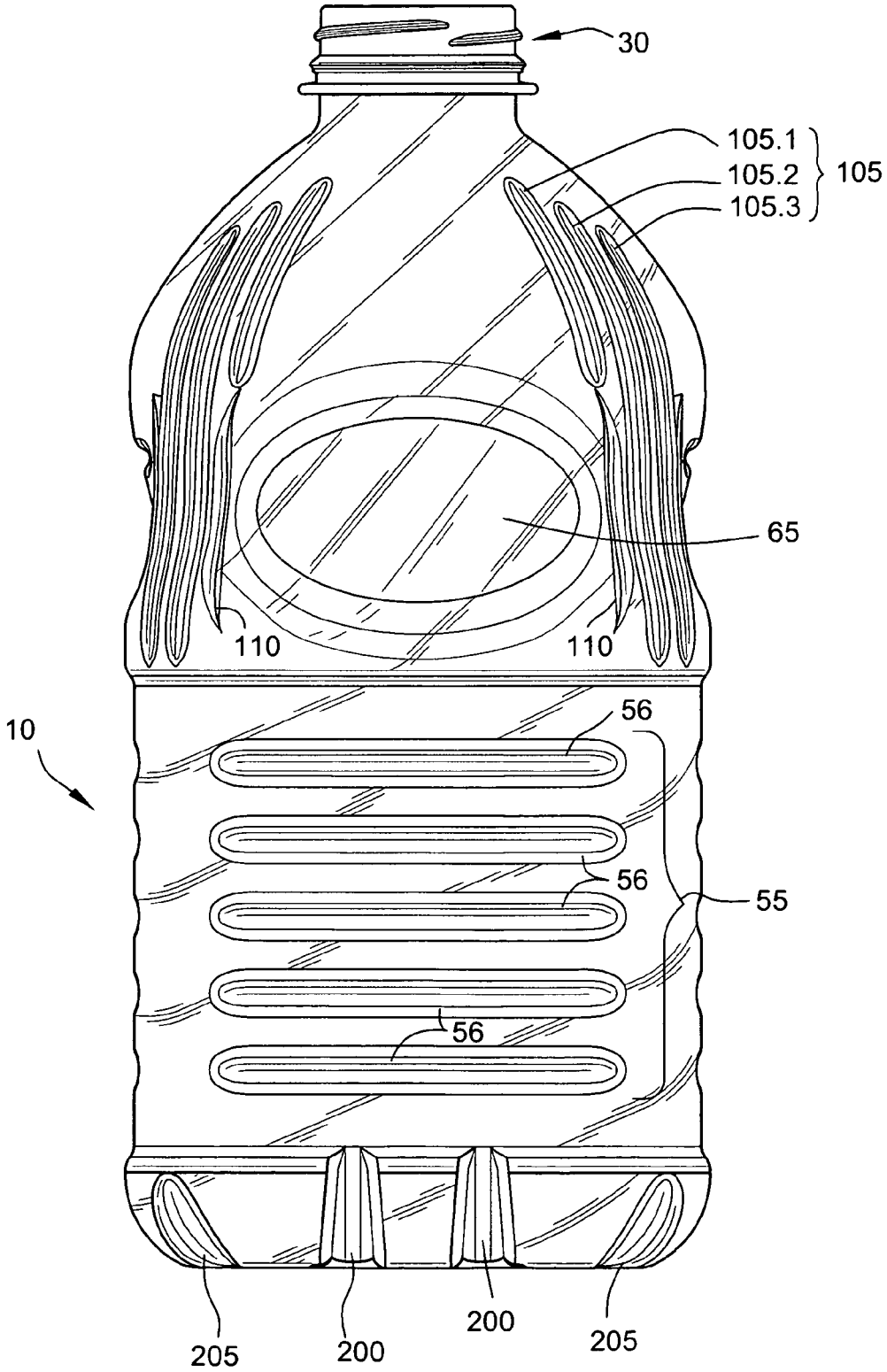
FIG. 17 is a front elevation view of a bottle according to yet another example of the present invention, the rear view thereof being identical thereto.

In the example of FIGS. 10-16, dome portion 60 includes a rib array 105 having first and second ribs 105.4, 105.5, which are partially overlapping or coextensive with one another. Rib 105.5 extends from or just above the transition between the top and bottom portions of the bottle to above or adjacent the grip portion 65. Rib 105.4 extends from the upper extent of rib 105.5 (at least partially coextensive) towards the neck 30, adjacent to and substantially parallel to a tapered vacuum deformation portion 300. FIG. 10 also shows a recessed cradle-like portion 350, shown on an enlarged perspective scale in FIG. 15, and in cross-section in FIG. 16. Cradle 350 is positioned on the top portion below the grip portion 65.

In the examples of FIGS. 2-9 and 17-18, the rib array 105 includes a set of three or more, e.g., three, reinforcing ribs. At least two of the ribs 105.2, 105.3 extend vertically from essential the transition between the top and bottom portions of the bottle to at least above or adjacent the grip portions 65, and at least one of the ribs 105.2, 105.3 may extend even higher, just below the neck. Rib 105.1 may be oriented towards the broader side of the bottle, and extends from below the neck down to the upper boundary of the grip portion 65.

Figure 18:
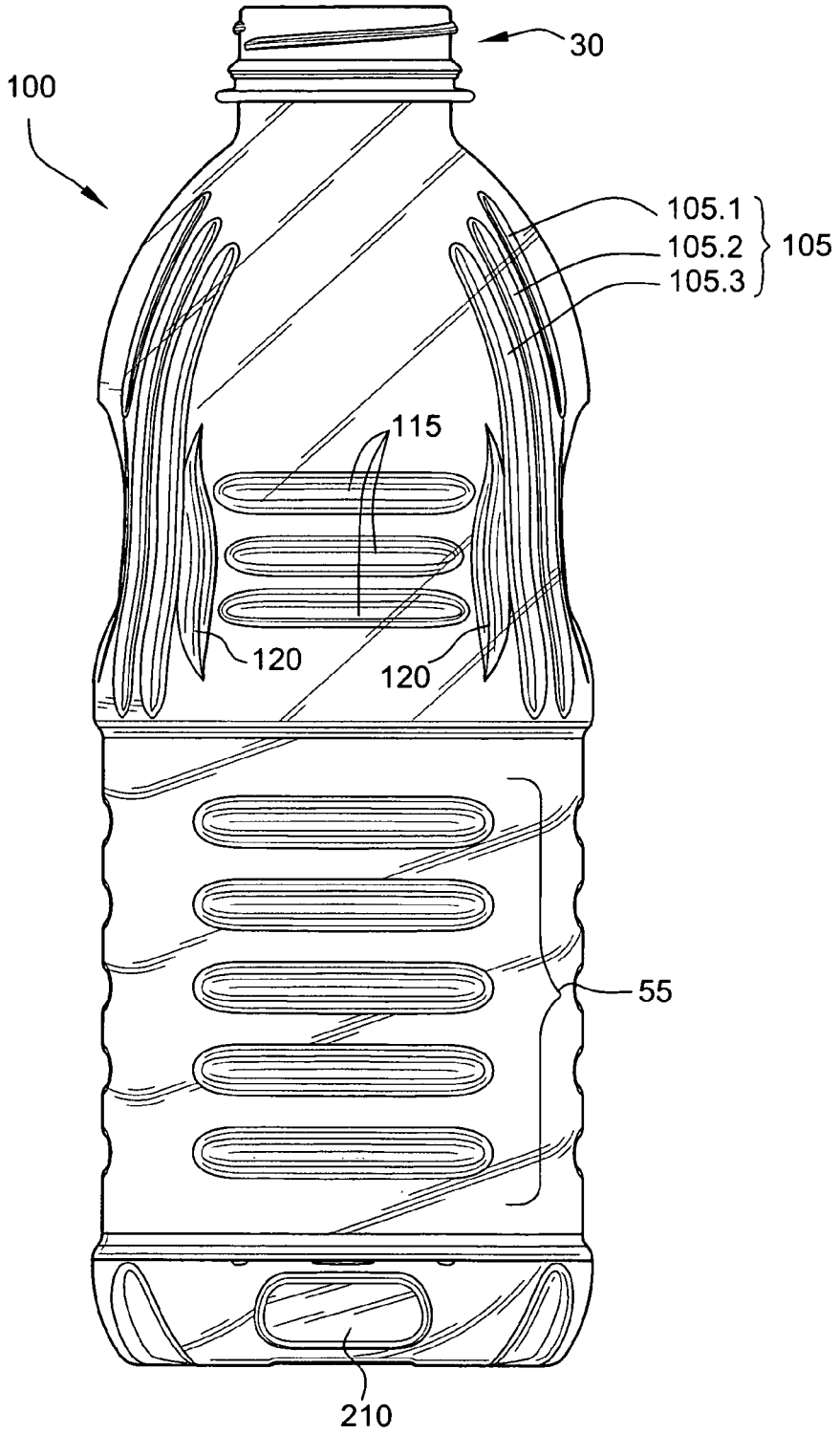
FIG. 18 is a left side view of the bottle shown in FIG. 17, with the opposite view thereof being identical thereto.

One or more additional relatively smaller ribs 110 (FIGS. 2 and 17) may be provided on each side of the grip portions 65. Further, as shown in FIGS. 3 and 18, one or more laterally extending ribs 115 (e.g., three lateral ribs having the same or different lengths) may be provided on each of the shorter walls 20 of the bottle. The shorter walls 20 may also include one or more relatively smaller ribs 120 provided on each lateral side of the horizontal rib(s) 115.

As shown in the example of FIGS. 17-21, the base of the bottle may incorporate side reinforcing ribs 200 that extend from underneath the bottle upward a small distance along the bottom sides. The ribs preferably do not extend into the push up portion of the base, as can be seen from FIG. 19. The side reinforcing ribs 200 are evident from the bottom, front and rear faces of the bottle.

In FIGS. 17-21, each bottom corner may also include a reinforcing rib 205 designed generally in the same fashion as the side ribs 200. The side 200 and corner ribs 205 visibly appear as cutouts. Each of the shorter bottom sides of the base portion includes a heel indent 210. Designed into the bottle's bottom plane, adjacent the heel indents, are indented anti-rock pads 215. The anti-rock pads 215 are designed to relieve outward bulging allowing the bottle to stand on the corners of the base in a stable manner.

Figure 19:
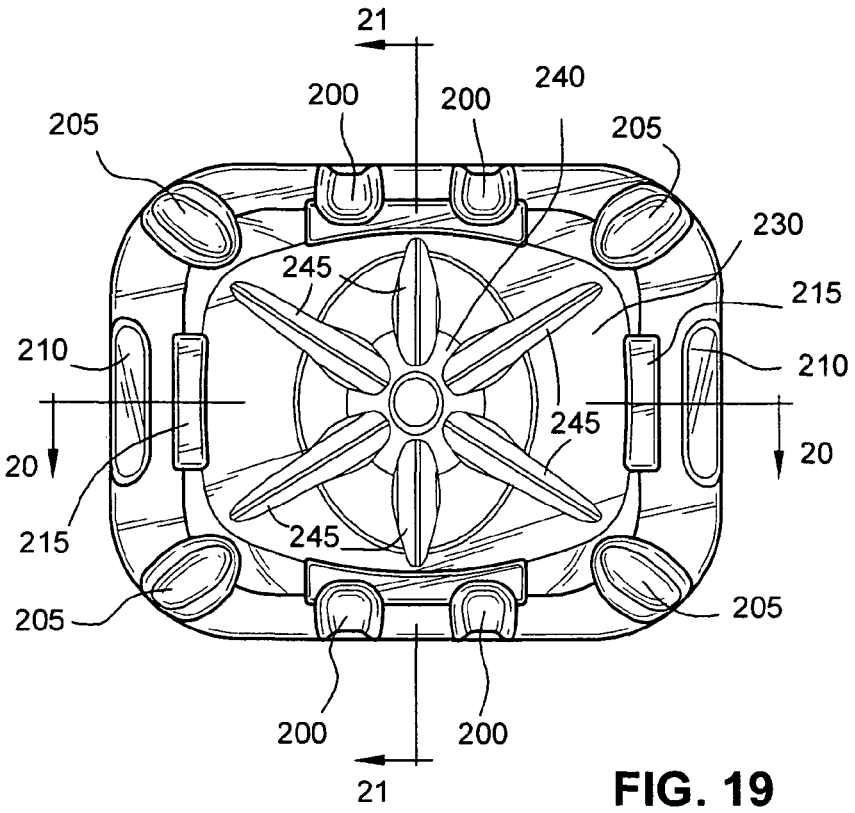
FIG. 19 is a bottom view thereof.
Figure 20:
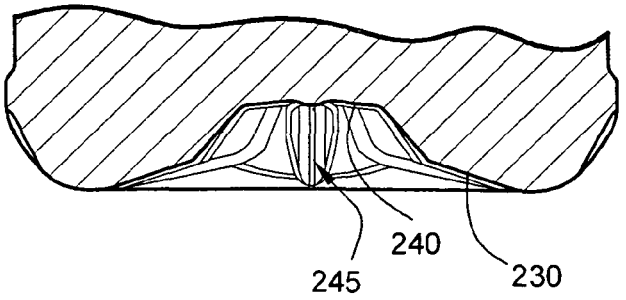
FIG. 20 is a cross-sectional view along lines 20-20 in FIG. 19.
Figure 21:
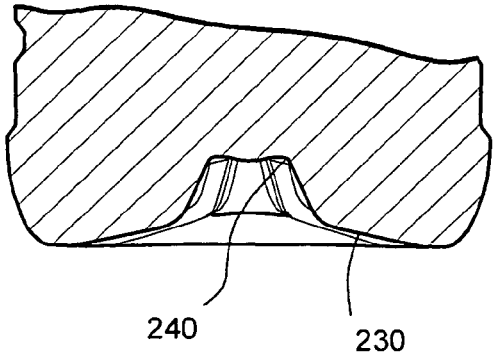
FIG. 21 is a cross-sectional view along lines 21-21 in FIG. 19.

As shown in FIGS. 19-21, the bottle may include a base portion having a push-up portion 85 with a two stage, elliptical shape. The first stage 230 is a relatively shallow oval or rectangular shape that transitions into a sharper round pushup second stage 240, with ribs 245 bisecting both areas.

Figure 5:
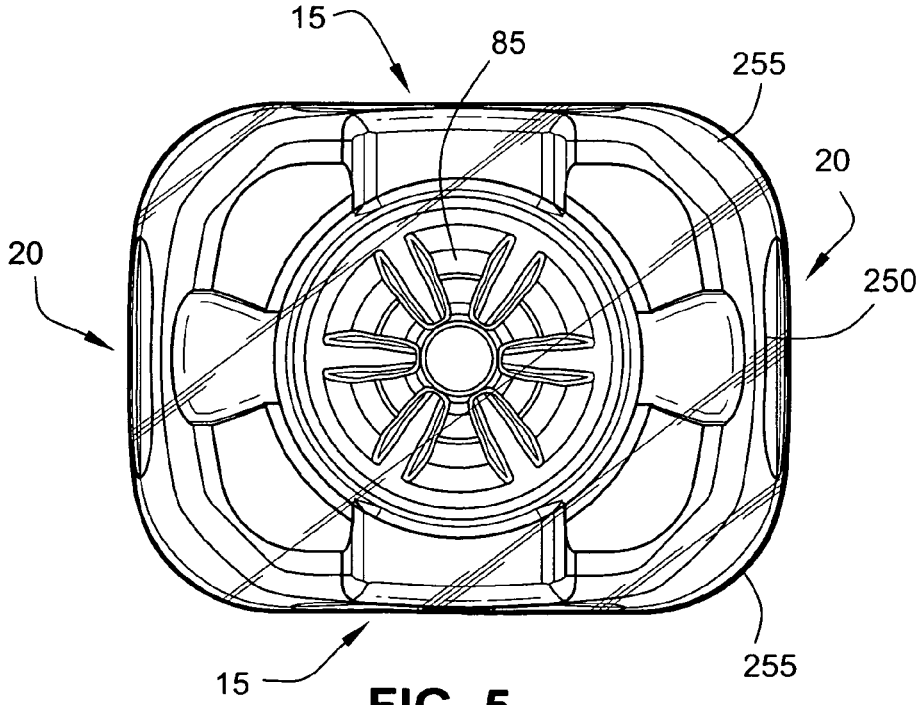
FIG. 5 is the bottom view of the bottle shown in FIG. 2.

As shown in FIGS. 3 and 5, the bottle may also include a tapered material 250 between heel corners 255 to provide stability while conveying. As shown in FIGS. 2 and 3, heel or base portion 25 includes a tapered portion 25.1 which divides load through an angle (1-5°) to reduce direct vector force, allowing for top heel increase and material reduction. Heel indents 25.2 are provided to strengthen heel in side to resist denting during handling.

The bottle may also include a vacuum array, e.g., including one or more vacuum deformation portions positioned on the top portion 45 of the main body. For example, as shown in FIGS. 2 and 10, one side of the bottle may include a recessed vacuum deformation portion 300 (e.g., having a tapered or trapezoidal shape) on the wider or longer side walls 15 of the top portion, e.g., between rib arrays 105 on adjacent corners. Another recessed vacuum deformation portion 305, e.g., having an hour glass shape (FIG. 3), may be provided on the shorter side walls 20 of the bottle, e.g., again between rib arrays 105 on adjacent corners. Also, the grip portion 65 may possess vacuum deformation capacity.

The rib array 105 is positioned and dimensioned to work in conjunction or to complement the function of the vacuum deformation portions 65, 300, and/or 305 in the top portion 45. Moreover, the rib array 105 works in harmony with the lower portion and/or base of the bottle for transferring load to the corners and/or heel, and/or for reinforcement of the bottle along substantially its entire extent, this while also reducing the amount of plastic required, e.g., by reducing the required thickness of the walls, thus resulting in a lightweight, strong and force accommodating bottle.

The rib array 105 may be positioned adjacent a lateral side of the grip portion 65 as well as the lateral side of the vacuum deformation portion 300 above the grip portion 65. For example, the upper portion of the rib 105.1 array may extend generally parallel to the tapered sides of the vacuum deformation portion (e.g., such that the ribs 105.1 overlap with the deformation portion 300 in the vertical plane), while the lower portion of rib 105.1 extends only to the top portion of grip 65. Also, the upper extent of the rib 105.3 may extend to and/or curve along the lower portion of the "figure-8" shaped vacuum deformation portion 305 on the shorter walls 20 of the bottle. In particular, the upper extent of rib 105.3 terminates at the recess or waist portion of the "figure-8" shape of the portion 305.

The top loading capacity of the overall container is increased by 35% compared to prior art bottles, e.g., U.S. Patent Publication No. 2006/0207962, incorporated by reference in its entirety. In one example, the strength ranges from about 50-150 lbs, and preferably the range is between about 75-125 lbs., and most preferably about 100 lbs. This is an advantage from the standpoint of shipping and for reduced material usage. Due to the increased top loading capacity, it is possible to eliminate or reduce the amount of corrugate that is placed between layers of bottles to be shipped. In addition, the increased top loading capacity adds stability to the bottle during the bottling/packing/labeling process, such that placement of labels can be more accurately registered. This increased strength is accompanied by a reduction in material or weight PET by about 8% compared to prior art bottles.

Figure 4:
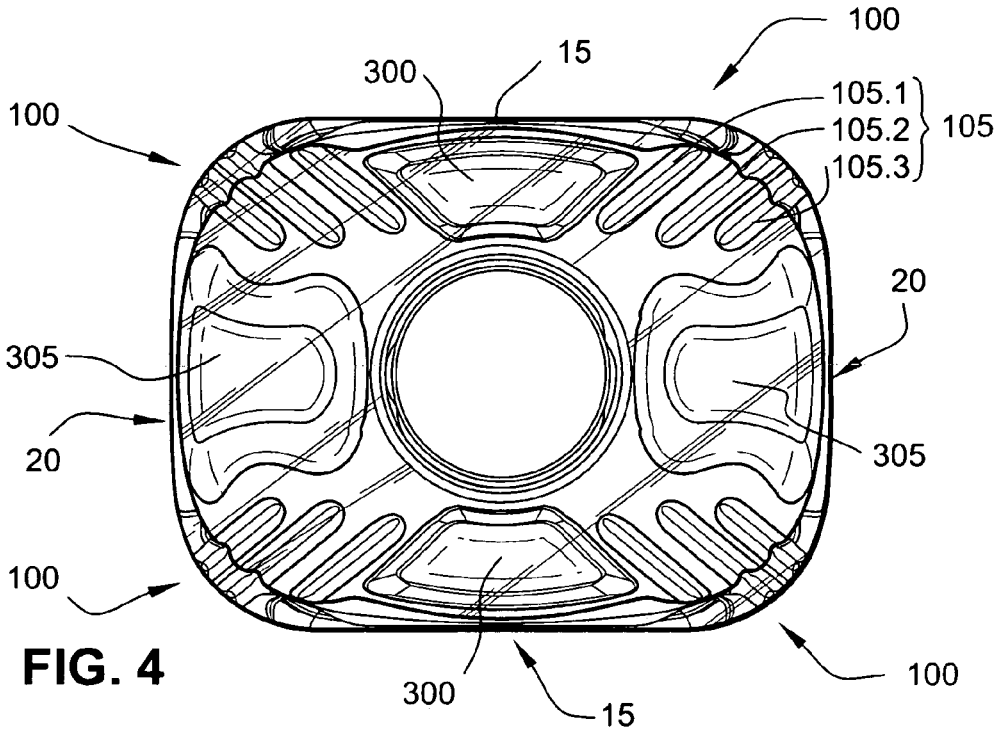
FIG. 4 is a top view of the bottle shown in FIG. 2.

Bottle 10 may have overall dimensions as described in U.S. Pat. Nos. 6,575,321, 6,749,075, 7,004,342 and 7,350,658. The dimensions of the bottle were selected to conveniently and efficiently fit on the shelves of a supermarket, in a space conserving manner. As shown in FIGS. 4 and 5, bottle 10 is substantially rectangular, for example, and includes longer sides 15 each having a width of about, e.g., 115 millimeters, and shorter sides 20 having a width of about, e.g., 90 millimeters. The dimensions bottle 10 can fit within the door shelf of a refrigerator. Base portion 25 (best shown in FIG. 2) of the container 10 has a width that is slightly greater than the widths of the sides 15, 20 of the container 10. Provisional Application Ser. No. 60/262,641, incorporated herein by reference, shows additional exemplary dimensions of bottle 10. In this particular embodiment, bottle 10 has a volume capacity of about 64 oz. Those of ordinary skill in the art would appreciate that aspects of the present invention are applicable to other containers, such as round or polygon shaped, e.g., square, pentagon, hexagon, septagon, octagon, etc., bottles, which may have different dimensions and volume capacities.

The grip portion 65 has a height that is about one quarter to about one half, and preferably one third, of a height of the top portion 45 of the body portion 40. The grip portion 65 is adapted to be grasped by the fingers and thumb of a person of average size, for example, an average woman having a size 7 hand. For example, as shown in FIG. 3, the distance between the grip portions 65 is about 83 mm or less, although the distance can range from about 75 to about 90 mm or more. However, the grip portion 65 is not limited for use by a person having average size hands. In this context, the width of the grip portion 65 is designed to be about 50-90% of the width of the container side wall on which it is placed. Preferably, the width is 60-80% (or more or less), and most preferably the width is about 70% of the width of the side wall. By selecting and structuring the height, width and depth of the grip portions 65 using the above dimensions, user comfort is enhanced, a good hand-fit is achieved, and the grip portions 65 can be manipulated by a persons having a wide variety of hand sizes.

The grip portion 65 is provided near the center of gravity of the container 10 (when empty or substantially filled). Thus, positioning of the grip portions 65 facilitates holding of and pouring liquid contents from the container 10.

Further, the grip portion 65 may also serve as a logo/label portion 70. As shown, each grip portion 65, may include a logo, such as "Ocean Spray®" and/or the Ocean Spray® "wave". The logo may include an anti-slip surface in the form of raised or embossed (depressed) lettering, logos, characters or other designs, which helps prevent the bottle 10 from slipping out of the user's fingers and thumb. Further, in addition to or instead of using integrally formed lettering, designs or logos, the logo may be in the form of a label that is applied, e.g., using an adhesive, to the grip portion 65. Stated differently, the grip portion 65 may also form an auxiliary label portion, which may be coordinated with the wrap-around label provided on the bottom portion of the container 10. If an integrally formed logo is used with the label, then it is recommended that the integral logo be embossed into the grip portion, rather than being raised, so as to present a more flat surface to which the label may be secured. Because of the increased size of the grip portion, the logo can be more prominently displayed on the bottle 10.

In FIGS. 1-16, the base portion 25 of the container 10 has a dome-shaped portion 85 which increases strength of the container 10 and facilitates the manufacturing process. The configuration and shape of the dome-shaped portion 85 may also help assist in the on for internal forces created during the hot-fill process, as is known in the art.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention. For example, while an exemplary hot-fillable container has been described, the disclosure is not limited to such and non-hot-fillable containers are also possible in which event vacuum panels would not be required. In addition, while PET containers made using a blow-molding process have been described, other materials and manufacturing processes are also possible. For example, the container can be made using extrusion molding or other stretch molding techniques, and the container could be made from materials such as, for example, polypropylene, high density polypropylene, polyolefin, styrene and other similar plastic materials.

The invention claimed is:

1. A plastic bottle, comprising:

a generally rectangular body portion having a top portion and a bottom portion, the top portion having at least one vacuum deformation portion, the top portion including a shoulder, a grip portion below the shoulder and at least one corner rib array including at least two ribs having different lengths and/or axially offset from one another, the rib array being positioned to work in conjunction with the vacuum deformation portion, the rib array being positioned laterally adjacent the grip portion, at least a portion of the grip portion and the rib array being located in a common horizontal plane.

2. The plastic bottle according to claim 1, wherein the ribs have different lengths.

3. The plastic bottle according to claim 1, wherein the ribs are offset from one another along a longitudinal axis of the top portion.

4. The plastic bottle according to claim 1, wherein the corner rib array includes three ribs, each of the ribs having different lengths.

5. The plastic bottle according to claim 1, wherein at least a first one of the ribs extends vertically from just above the bottom portion of the bottle to at least above or adjacent the grip portion.

6. The plastic bottle according to claim 5, wherein at least a second one of the ribs extends higher than the first one.

7. The plastic bottle according to claim 1, wherein the rib array includes a third rib oriented towards a broader side of the bottle, and extends from a neck down to an upper boundary of the grip portion.

8. The plastic bottle according to claim 1, further comprising one or more additional relatively smaller vertical ribs provided on each side of the grip portion.

9. The plastic bottle according to claim 1, wherein the top portion includes a pair of relatively longer walls and a pair of relatively shorter walls, and the bottle further comprises one or more horizontal ribs provided on each of the shorter walls of the top portion.

10. The plastic bottle according to claim 9, wherein each of the shorter walls includes one or more relatively smaller vertically oriented ribs provided on each lateral side of the one or more horizontal ribs.

11. The plastic bottle according to claim 1, further comprising an array of vacuum deformation portions, including the at least one vacuum deformation portion, positioned on the top portion of the main body.

12. The plastic bottle according to claim 11, wherein the grip portion includes a first vacuum deformation portion of the array, and a second vacuum deformation portion is provided above and spaced from the grip portion.

13. The plastic bottle according to claim 12, wherein the second vacuum deformation portion has a tapered or trapezoidal shape.

14. The plastic bottle according to claim 12, wherein the second vacuum deformation portion is positioned between corner rib arrays on adjacent corners.

15. The plastic bottle according to claim 12, further comprising a third vacuum deformation portion horizontally provided on shorter side walls of the bottle, laterally adjacent to and generally horizontally aligned with the second vacuum deformation portion provided on longer side walls of the bottle.

16. A plastic bottle, comprising:

a generally rectangular body portion having a top portion and a bottom portion, the rectangular body portion including relatively longer and shorter side walls, the top portion including a shoulder and opposed grip portions below the shoulder, said top portion including a vacuum panel array including a first vacuum deformation portion provided as part of each said grip portion, a second vacuum deformation portion provided above each said grip portion, and a third vacuum deformation portion provided on the shorter side walls of the bottle.

17. The plastic bottle according to claim 16, wherein the second vacuum deformation portion has a tapered or trapezoidal shape.

18. The plastic bottle according to claim 16, wherein the second vacuum deformation portion is positioned between vertically extending corner ribs on adjacent corners.

19. The plastic bottle according to claim 16, wherein the third vacuum deformation portion is provided laterally adjacent to the second vacuum deformation portion.

20. A plastic bottle, comprising:

a generally rectangular body portion having a heel, a top portion and a bottom portion, the top portion having at least one vacuum deformation portion, the top portion including a shoulder, a grip portion below the shoulder and at least one corner rib array including at least two ribs each extending laterally adjacent the grip portion and having a length greater than a height of the grip portion, the rib array being positioned and dimensioned to work in conjunction with the vacuum deformation portion, to transfer load to the corners and/or heel, and to reinforce the bottle, at least a portion of the grip portion and the rib array being located in a common horizontal plane.

21. The plastic bottle according to claim 20, further comprising an array of vacuum deformation portions including the at least one vacuum deformation portion, a first vacuum deformation portion provided as part of the grip portion and a second vacuum deformation portion spaced above the grip portion.

22. The plastic bottle according to claim 21, wherein the second vacuum deformation portion tapers downward towards the top portion.

23. A plastic bottle, comprising:

a generally rectangular body portion having a top portion and a bottom portion, the top portion having a relatively longer wall and a relatively shorter wall, the top portion including a shoulder and a grip portion below the shoulder, the grip portion being recessed into the top portion, the grip portion defining a main surface recessed to a first depth and surrounded by a perimeter, said perimeter being located exclusively on the relatively longer wall of the top portion, at least a portion of the perimeter along the upper portion or brow being recessed to a second depth that is deeper than the first depth.

24. A plastic bottle, comprising:

a generally rectangular body portion having a top portion and a bottom portion, the top portion including a shoulder, a grip portion below the shoulder and heel corner portions below the bottom portion; and a tapered material between adjacent heel corners to provide stability while conveying, the tapered material being centrally located along a lower edge of a relatively shorter side of the bottom portion.

25. The plastic bottle according to claim 1, further comprising a recessed cradle portion positioned on the top portion below and spaced from the grip portion, wherein the cradle portion has a shape that is at least partially complimentary to the shape of the grip portion.

26. The plastic bottle according to claim 25, wherein the cradle portion has a central portion and an end portion on each lateral side of the central portion, each lateral side having a height that is greater than a height of the central portion.

* * * * *